United States Patent [19]

Hahn

[11] 4,425,057

[45] Jan. 10, 1984

[54] METHOD OF MINING

[75] Inventor: John A. Hahn, Johannesburg, South Africa

[73] Assignee: IPI Contractors AG, Switzerland

[21] Appl. No.: 200,186

[22] Filed: Oct. 24, 1980

[30] Foreign Application Priority Data

| | | | |
|---|---|---|---|
| Oct. 26, 1979 | [ZA] | South Africa | 79/5752 |
| May 14, 1980 | [ZA] | South Africa | 80/2884 |
| Aug. 12, 1980 | [ZA] | South Africa | 80/4920 |
| Oct. 26, 1980 | [ZA] | South Africa | 80/5591 |

[51] Int. Cl.[3] ..... E02D 15/00

[52] U.S. Cl. ..... 405/258; 405/288; 405/290

[58] Field of Search ..... 405/258, 262, 229, 230, 405/288, 290, 138–145; 299/11–13

[56] References Cited

U.S. PATENT DOCUMENTS

| | | | |
|---|---|---|---|
| 931,466 | 8/1909 | Nellen | 405/288 X |
| 1,661,238 | 3/1928 | Sloan | 405/288 |
| 3,831,384 | 8/1974 | Kempster | 405/258 |
| 4,019,327 | 4/1977 | Kempster | 405/288 X |
| 4,341,491 | 7/1982 | Neuman | 405/258 |

FOREIGN PATENT DOCUMENTS

| | | | |
|---|---|---|---|
| 481357 | 8/1929 | Fed. Rep. of Germany | 405/258 |
| 497889 | 5/1930 | Fed. Rep. of Germany | 405/258 |
| 1158931 | 12/1963 | Fed. Rep. of Germany | 405/258 |
| 1224254 | 8/1966 | Fed. Rep. of Germany | 405/258 |
| 2303121 | 1/1976 | France | 405/258 |

*Primary Examiner*—Dennis L. Taylor

*Attorney, Agent, or Firm*—Karl W. Flocks; A. Fred Starobin

[57] ABSTRACT

In mining the hanging wall is supported by pillars comprising a particulate backfill material which has been consolidated so that it has at the most one quarter voids by volume. Layers of reinforcing material are provided in the backfill to take horizontal loads associated with vertical loads being taken by the pillars in supporting the hanging wall. The pillars extend back from a work space behind the work face transversely to the work face. They are spaced in a direction along the workface and their loading ends advance as the work face advances.

15 Claims, 31 Drawing Figures

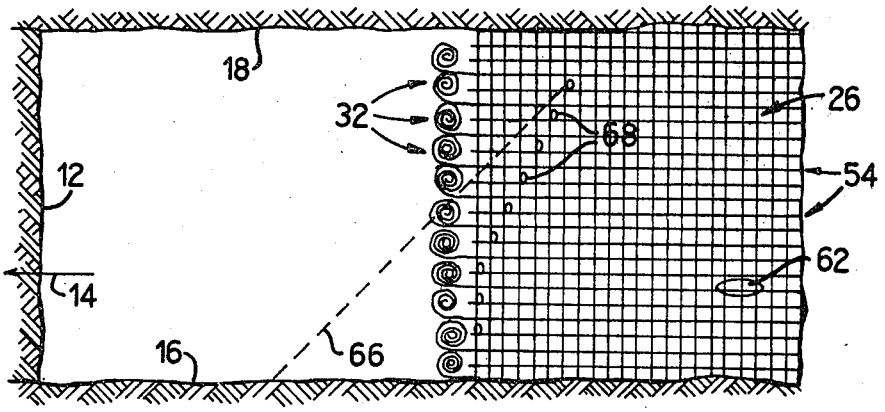
FIG. 7
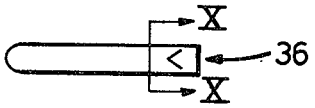
FIG. 8
FIG. 10
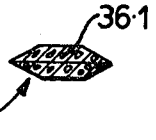
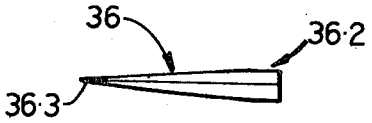
FIG. 9
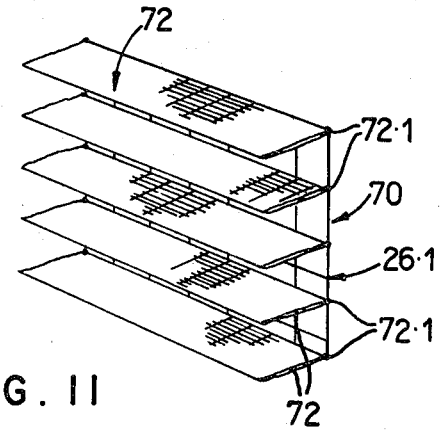
FIG. 11

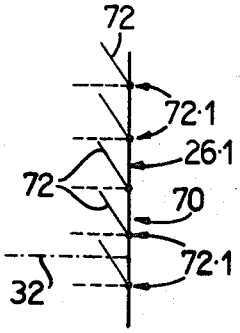
FIG. 12
FIG. 13
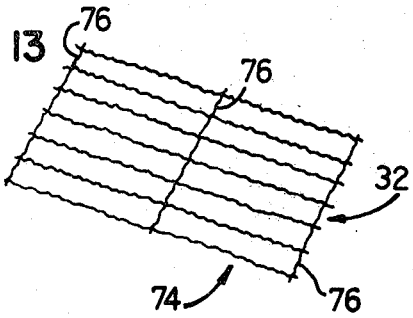
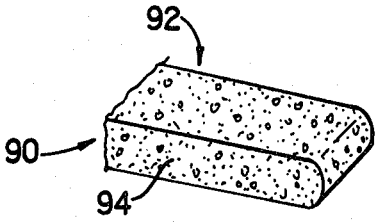
FIG. 14
FIG. 15
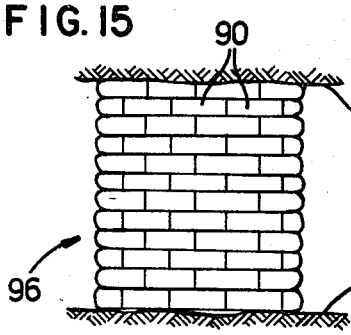
FIG. 16
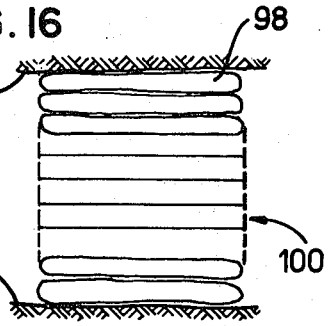
FIG. 17
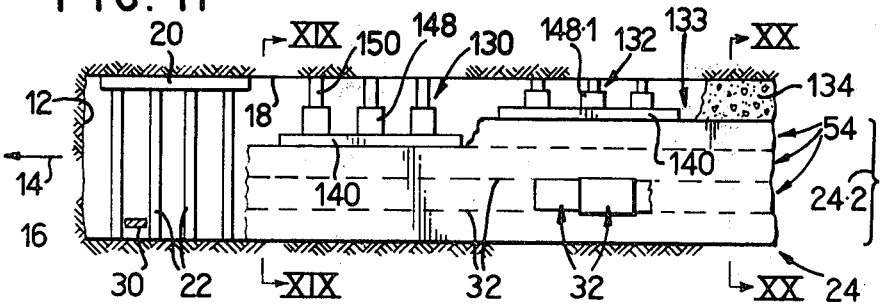

METHOD OF MINING

This invention relates to a method of mining. It relates in particular to a method of supporting the hanging wall in a mine, or in other undergound workings, particularly a coal mine, or in any mine in which the volume of ore or valuable fraction extracted is large in relation to the ore left behind for support.

In the past, coal has been mined by a method known to the Applicant as the 'bord and pillar' method. It is also sometimes referred to as the 'pillar and stall' method. This method results in large volumes of coal being left as pillars for support of the hanging wall underground.

The stress imposed upon pillars left for support underground, depends upon the depth at which mining takes place below the surface. The nature of the overburden will also be considered in determining the load on the pillars and hence the stress.

According to experts in this field, the earth's crust, prior to mining, is in equilibrium under the action of compressive stressses, also referred to as primitive stresses. The vertical component of the primitive stress in geologically undisturbed ground, is given by the equation $$q=24{,}88\ H=25\ H\ \text{kPa}$$

(Rock Mechanics in Coal Mining, Salamon & Oraveccz, page 16, published by the Chamber of Mines, South Africa, 1976).

In this equation the density of the rock is assumed to be 2744 kg per cubic meter. At depth H (in meters), the vertical component (q in kPa) of the primitive stress is equal to the pressure exerted by the mass of a rock prism of cross-section one square meter and height H meters.

The horizontal component of the primitive stress is regarded by them as being equal in all directions and as being a constant proportion K of the vertical stress. In South African collieries, the value of K is given by them (S&O) as ranging from 0.1 to 0.4.

On this basis the following Table gives the vertical components of the primitive stress underground, before mining:

| Depth below Surface Meters | Vertical Component of Primitive Stress (kPa) |
|---|---|
| 30 | 750 |
| 100 | 2 500 |
| 150 | 3 750 |
| 200 | 5 000 |
| 300 | 7 500 |

Removal of rock by mining underground raises the average stress in pillars left for support. It is believed that the increase in the average stress will be approximately in the ratio:

Total area mined : area of pillars.

A method of calculating the load on pillars is given by S&O, page 22. They also recommend (page 41) a factor of safety of 1.6 in the design of supports. In other words, the calculated load on a pillar will be increased by an amount corresponding to the factor of safety, and the pillar will then be designed to take such increased load.

It is an object of this invention to provide a method of support for the hanging wall underground in mines, which will permit the extraction of greater volumes of coal and the leaving of less coal underground for support, than with other mining methods known to the Applicant.

Accordingly, in mining, there is provided a method of supporting the hanging wall which includes providing support pillars extending between the hanging wall and the foot wall, the pillars having lower portions incorporating particulate backfill material which has been consolidated so that it has, at the most, one-quarter voids by volume.

If desired, the lower portion of a pillar may have only one-fifth voids by volume.

The backfill material may be fine such that about half by mass would pass a sieve of 0.85 mm, and such that only about 1% by mass would be retained on a sieve size of 6.75 mm.

The particulate material used as a backfill in the pillar may be in the form of soil, sand, tailings from previous mining operations, or quarried material, ash, burnt dolomite, or limestone, or the like. Thus, in coal mines which have low grade coal which may not be suitable for other uses, the coal may be burnt for example in a fluid bed or other system with dolomite and limestone. The ash and burnt dolomite and limestone may then be crushed, and may then be used with or without other materials as a backfill. Such burnt ash and dolomite and limestone may be very advantageous in providing a cementitious binding material in the backfill.

Different particulate materials have different natural angles of repose or angles of internal friction. When a particulate material is confined to form a pillar, and a vertical load is then applied to the pillar, then interparticulate friction causes a horizontal component of the vertical load to be imparted to the particles in the pillar. This horizontal component causes a stress which tends to cause lateral displacement of the material. If the vertical load is increased until failure occurs, then failure takes place in diagonal tension along planes, also referred to as shear planes.

For a particulate material having an angle of internal friction A, it is believed that the relationship between the horizontal component and the vertical load is given by the following expression:

$$L_H=C\cdot L_v,$$

where $L_v$ is the vertical load imposed on the pillar;

$L_H$=the horizontal component of the load; and

C=

$$\frac{1-\sin A}{1+\sin A};$$

where angle A depends on the particulate material being used.

When the angle A=30° then C=⅓.

The magnitude of $L_H$ therefore depends upon the angle A. The angle which the shear planes make with the horizontal is $$\left(45^\circ + \frac{A^\circ}{2}\right).$$

The lower portion of a pillar may be provided by the erection of retaining walls and by the hydraulic placement of the particulate backfill material in a hydraulic carrier behind the retaining walls, the consolidation of the particulate backfill material taking place by settlement of the particulate material under gravity in the hydraulic carrier. Thereafter, the hydraulic carrier may be allowed to drain away.

Alternatively, the particulate backfill material may be pneumatically placed behind the retaining walls, the consolidation of the particulate backfill material taking place by the discharge of the material at speed under pneumatic pressure.

The consolidation of the backfill material in the lower portion of a pillar may take place by the application of mechanical force to the backfill material. Alternatively, or in addition, consolidation of the backfill may include exerting pressure on the lower portion in a clearance space between such lower portion and the hanging wall, and by abutment against the hanging wall before filling up the clearance space with load-taking fill. The pressure exerted on a lower portion before filling of the clearance space may be at least 9/10ths of the load which the pillar is expected to take. Preferably, the pressure exerted is in excess of the load which the pillar is expected to take.

Generally, if desired, the step of consolidation of a layer by pressure may be preceded by compaction of this layer by impact, vibration, or the like. Such compaction may take place by stampers, vibrators, or the like. Vibration and compaction methods may be used throughout the construction process to assist in achieving effective consolidation, including the use of external removable supporting formwork, shapes, or structures. The pressure may be exerted by a shoe or platen which may also be subjected to vibration while pressure is being applied. Pressure may be applied by abutment of a press against the hanging wall. The platen may have a slight camber transversely to the direction of the pillar.

The making of the pillar may include the final step of providing a load-taking fill which may be in the form of a layer of grout in between the hanging wall and an upper layer of backfill. The grout may be tamped or rammed in under pressure to ensure that there is active support between the upper layer of the pillar and the hanging wall.

Alternatively, the provision of the load-taking fill on top of the lower portion may include the driving in of wedges into the clearance space between the lower portion and the hanging wall, thereby exerting a downward pressure on the lower portion. As a further alternative, the load-taking fill may be provided on top of the lower portion by pumping particulate material carried in suspension by a hydraulic carrier, into the clearance space, the pumping taking place under hydraulic pressure to ensure that a downward pressure is exerted on the lower portion by abutting against the hanging wall.

The lower portion of a pillar may be built up in layers of backfill with layers of reinforcing material at different elevations between layers of backfill in the lower portion. The vertical spacing between layers of reinforcing material may, at the most, be equal to one-third the minimum cross-sectional dimension of the pillar. The pillar may include opposing retaining walls on its opposite sides, and the reinforcing material may engage with the retaining walls to constrain them against outward bulging.

The reinforcing material may comprise uninterrupted sheet material, expanded sheet material, or mesh, such as wire mesh or netting, steel grid or plate, metal strips or sheets. It may also comprise materials such as synthetic polymers, e.g. polyurethane, polystyrene, polyethylene, and so on, cloth-like synthetic fibres, wooden lath structures, metal strips or sheets, and so on. The reinforcing material may comprise the combination of two or more of the above-mentioned items. Thus, for example, a sheet of polymer could be reinforced by steel and wire mesh or by synthetic or natural fibre mesh or cloth. The reinforcing material may, if desired, also be in the form of a slab, metal plate, fibreglass moulding, or a geotextile. It is designed to accept, with a sufficient factor of safety, the horizontal component of load $L_H$ associated with the vertical load on the pillar. The reinforcing layer may have indentations or projections providing an uneven surface so as to improve the frictional grip between the layer and the particulate material in contact with it. If desired, fibreglass or other material may be reinforced by high tensile wire. Alternatively, if desired, the reinforcing layer may be in the form of a relatively thin concrete slab which has been prestressed by arrays of high tensile wires at right angles to each other.

The particulate backfill material may be made up into the form of gabions which comprise the backfill material contained in envelopes of reinforcing material, and in which the lower portion of a pillar is built by laying the gabions in layers. At least some of the gabions may be pre-compressed before being installed.

The invention extends to a pillar when made according to the method as described.

The invention extends also to a method of mining, which includes providing a plurality of pillars behind a work place adjacent a work face, the pillars being provided in accordance with the method as described, and being spaced in a direction along the work face and extending back in the direction transversely to the work face. The lengths of pillars in a direction transverse to the work face may be at least twice the width of the pillar in a direction along the work face.

The adjacent pillars may be strengthened against outward bulging under load by having beams extending along their lengths in a direction transverse to the working face, the beams being supported by struts spaced in series generally in a direction away from the work face, and the struts themselves extending generally in a direction along the work face. The spacing between struts may, at the most, be equal to the minimum cross-sectional dimension of the pillars.

The invention extends also to a method of building pillars underground for supporting the hanging wall in underground mining operations, which method includes calculating the vertical load which a pillar is to take, calculating the horizontal component of load associated with such vertical load, laying particulate materials in layers between hanging wall and foot wall, consolidating such layers, and providing reinforcing material within or between the layers of particulate material to accept, with the desired degree of safety, the horizontal components of load associated with the vertical load which the pillar is expected to take.

The invention will now be described by way of example with reference to the accompanying diagrammatic drawings.

In the drawings,

FIG. 7 shows a side elevation of the front end of a pillar during building;

FIG. 8 shows a plan view of a wedge suitable for use in building pillars;

FIG. 9 shows a side elevation of the wedge, corresponding to FIG. 8;

FIG. 10 shows a cross-section taken at X—X in FIG. 8;

FIG. 11 shows, an oblique side view of a template element for defining the side of a pillar;

FIG. 12 shows diagrammatically an end view of the template element of FIG. 11;

FIG. 13 shows a detailed view of the mesh used as reinforcing material between opposing template elements in use;

FIG. 14 shows one end of a gabion suitable for use in the making of a pillar according to another aspect of the invention;

FIG. 15 shows a cross-sectional end elevation of a pillar when made with gabions of FIG. 14;

FIG. 16 shows a cross-sectional end elevation of a pillar when made with gabions having a length equivalent to the width of the pillar;

FIG. 17 shows a sectional side elevation of the underground working of a mine, in which a pillar according to another aspect of the invention, is being built;

Figure 1:
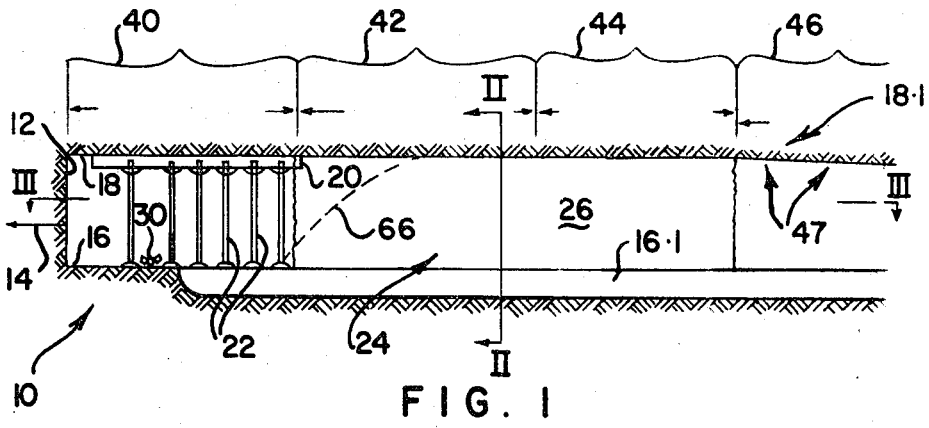
FIG. 1 shows a sectional side elevation of a working place in a coal mine, taken at I—I in FIG. 3 of the drawings.

Referring to the drawings, reference numeral 10 refers generally to a work place underground in a coal mine. It has a work face 12 which advances in the direction of arrow 14. The coal face extends between the foot wall 16 and the hanging wall 18. Immediately behind the work face, the hanging wall 18 is supported by a head plate 20 which is itself supported by a plurality of props 22. These props and head plate extend rearwardly, more or less in line with the forward end of pillars 24 which are arranged to advance at more or less the same rate as the working face.

The pillars 24 are made by the use of retaining walls 26 on either side, the space between such walls and the hanging wall and foot wall is then filled with a particulate backfill material. This may be in the form of ash, external make-up in the form of sand or soil, gas beton, waste, in any proportions. When sufficient waste material is not available, then the foot wall 16 may be undercut as at 16.1 in the spaces between pillars 24.

Figure 3:
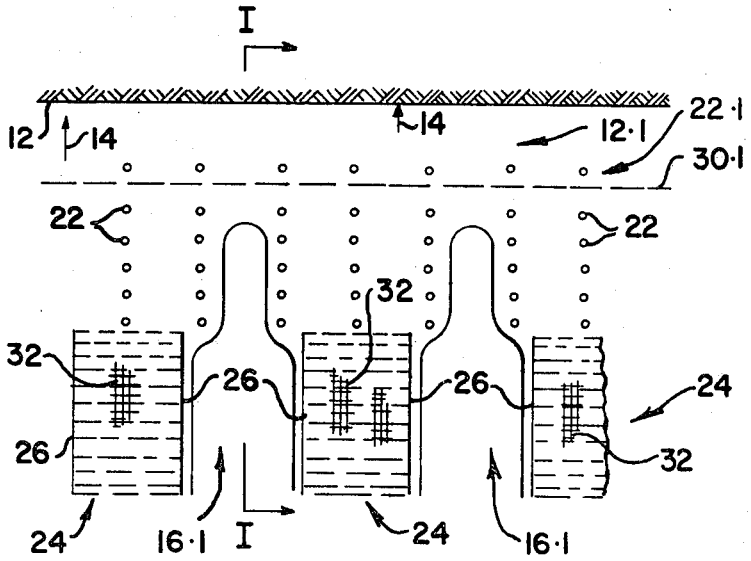
FIG. 3 shows a sectional plan taken at III—III in FIG. 1 of the drawings.

Just behind the work face 12, a work space 12.1 is left free for mining activity. Immediately behind the first line 22.1 of props 22, there is provided a conveyor belt 30 whose centre line is indicated in FIG. 3 by reference numeral 30.1.

In operation, pairs of retaining walls 26 will be arranged in spaced relationship extending rearwardly from near the working face. Several pairs of retaining walls 26 are so provided and are located in spaced relationship along the width of the coal face relative to other retaining walls for other pillars.

The retaining walls 26, as described, may be in the form of cladding which is capable of advance to follow at more or less the same rate as the rate of advance of the work face. However, such cladding 26 may instead be permanent and may be of cementitious material and mesh. The opposing retaining walls 26 of a pillar may be tied together by means of reinforcing material 32. Where the cladding 26 is movable, the attachment between the material 32 and the cladding 26 will be of a temporary or disconnectable nature. However, when the cladding 26 is in the form of a permanent or semi-permanent structure, such as a cementitious coat with reinforcing, then the connections between the reinforcing material 32 at different elevations, and the cladding 26, may be permanent.

Referring now to FIG. 1 of the drawings, it will be noted that immediately behind the work face the hanging wall 18 is supported by the head plate 20 together with its supporting props 22. This zone 40 will be a non-subsidence zone.

Immediately behind the props, there follows what is regarded as a safe zone 42 which contains also the forward end of the pillar 24. The broken material between the retaining walls 26, rests at an angle of repose, indicated by reference numeral 66. The immediately adjacent zone rearwardly, is a zone 44 in which settling has not yet taken place. It is in the next zone 46 that the hanging wall 18 first bears up against the upper end of the pillar 24, as shown at 47.

Immediately behind the zone 44, there is the settled zone 46 where the hanging wall 18 has already settled onto the upper end of the pillar 24. It will be noted that the hanging wall 18.1 in zone 46 is at a somewhat lower level than the hanging wall 18 immediately behind the work face 12.

The fill, when introduced into the space between the retaining walls may be tamped to ensure good contact with the hanging wall. Alternatively, or in addition, the space above the lower portion of the pillar and between the fill and the hanging wall may be grouted. The purpose is to obtain early acceptance of the load preferably before roof fracture takes place from subsidence.

The retaining walls can be very thin and could in fact be in the form of a skin merely, and when in the form of cladding may be movable for later re-use. Alternatively, depending upon economics, the retaining walls may be left in situ. The prime purpose of the retaining walls is to ensure that the particles of fill do not fall out at the sides of the running pillars.

For ease of advance of the work face, the conveyor 30 may be mounted upon transverse skids to permit easy displacement towards the work face in a direction transverse to its longitudinal axis 30.1.

The members 32 act as reinforcing members and may be in the form of metal plate or metal sheet or wire mesh. They need not be connected to the retaining walls 26 as long as the retaining walls 26 ensure that the particles of the backfill do not fall out.

Figure 2:
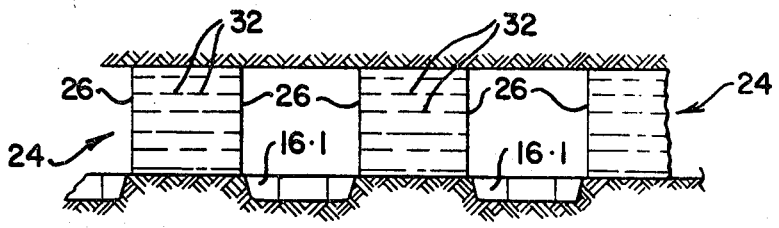
FIG. 2 shows a sectional elevation taken at II—II in FIG. 1 of the drawings.
Figure 4:
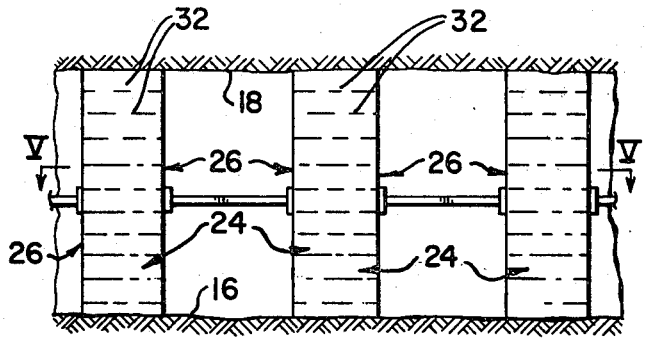
FIG. 4 shows a cross-sectional elevation at IV—IV in FIG. 5, through a plurality of pillars spaced along the work face in another arrangement.
Figure 5:
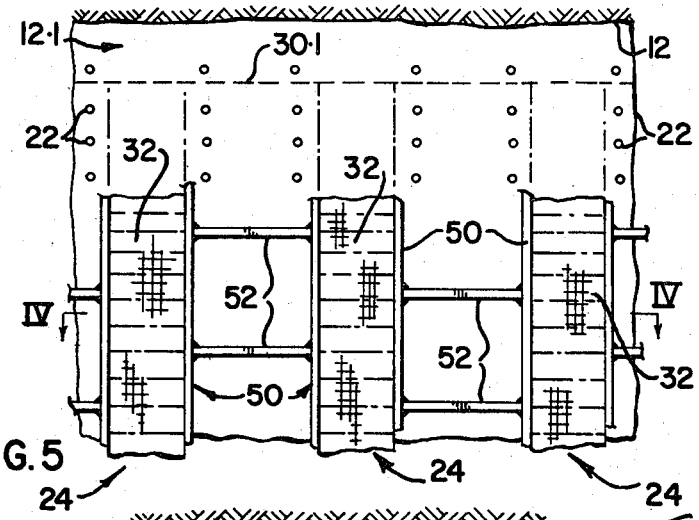
FIG. 5 shows a sectional plan view at V—V in FIG. 4, of the pillars of FIG. 4.

Referring to FIGS. 4 and 5 of the drawings, the arrangement of the pillars at the work face is similar to that described with reference to FIGS. 1 to 3 of the drawings. Like reference numerals refer to like parts. The pillars 24 shown in FIGS. 4 and 5 are however, taller. In order to provide strength in the middle against outward bulging under load, beams 50 are provided on opposite sides of the columns 24. These beams are supported by struts 52 spaced in series, generally in a direction away from the work face. The struts themselves extend generally in a direction along the work face, and are provided across spaces which are not required for access to the work face.

Figure 6:
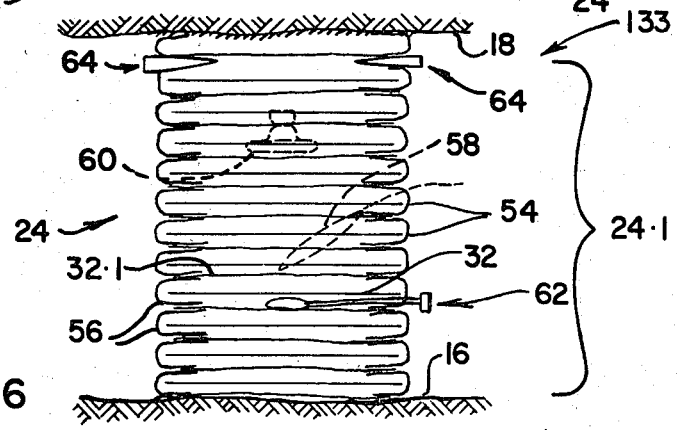
FIG. 6 shows a cross-sectional elevation through a pillar during the final stages of building.
Figure 18:
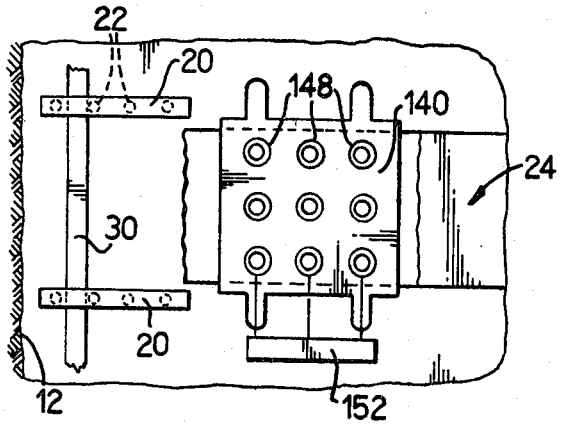
FIG. 18 shows a part plan view corresponding to FIG. 17.

Referring to FIG. 6 of the drawings, reinforcing material in the form of wire mesh 32 and 32.1 are shown inside backfill arranged in layers 54. The thickness of a layer 54 is defined by U-shaped wire mesh side members 56. The layers of backfill are consolidated by vibration or compaction by making use of a vibrator 58 or compactor 60.

In order to monitor the behaviour of the pillar 24 under load, a pressure-sensitive device 62 is embedded within the backfill. Readings or recordings can then be taken periodically of the pressure in the backfill.

After the lower portion 24.1 of the pillar 24 has been built up then the clearance space between the top of the lower portion 24.1 and the hanging wall 18 may be taken up by wedges 36.

Referring to FIGS. 8, 9, and 10 of the drawings, there is shown a wedge 36 which is made of concrete and which has reinforcing 36.1. The wedge is tapered from a parallel portion 36.2 at its rear end to a thin, pointed end 36.3 at its front end. The wedges may be from half a meter to one and half a meters in length. A wedge may be tapered over most of its length, i.e. from a pointed end rearwards. But at least one-quarter of its length, at the rear end, will be parallel to ensure that it is not ejected under load. The wedges may be of concrete, and may be driven by wooden mallets. If desired, the wedges may be reinforced with steel rod or wire mesh or netting embedded within it. The wedges may also be of hardwood or plastic.

Referring to FIG. 7 of the drawings, the retaining walls 26 are shown made of wire mesh having a coat of cementitious material. The natural angle of repose of the particulate material being charged into the space between the opposed retaining walls 26 is indicated by reference numeral 66. The front end of the particulate material may, however, be confined by providing a plurality of bars 68.

The reinforcing means 32 separating the backfill into courses ensures that instead of a single tall pillar there is provided a plurality of squat pillars on top of one another. By merely containing the sides of the courses to prevent falling away at the sides, a robust pillar having a high load-bearing capacity is provided.

The retaining walls 26 and reinforcing means 32 may be provided in roll form, and may be unrolled in the direction of advance of the working face, as indicated by arrow 14, as the working face advances and as the pillar advances.

Referring now to FIGS. 11 and 12 of the drawings, there is shown a template element generally indicated by reference numeral 70 and comprising a retaining wall member 26.1 and leaf elements 72 flexibly or hingedly connected to the retaining wall member 26.1. In order to facilitate transport, the leaf elements 72 may be provided with hinges 72.1 extending along their lengths. This will permit folding of the template element into a narrower item which can be more easily transported than when it is wide. The retaining wall member 26.1 may be made up of wire of 2 to 3 mm diameter at spacings of 15 to 20 cm square. It may, however, have openings which may be larger or smaller, or which may be rectangular in shape, depending upon what is required to contain the backfill.

The leaf elements 72 may be made up of a mesh such as is shown in FIG. 13. It will be noted that there are many more wires 74 in the one direction than wires 76 in the other direction. In use, the mesh will be laid in such a manner that the wires 74 extend transversely across the width of a pillar, and the wires 76 extend longitudinally. The stressable area of the reinforcing means 32 in a direction across the width of the pillar 24 will be about 10 to 40 times as much as the stressable area of the reinforcing means, in a longitudinal direction relative to the length of the pillar. If desired, the wires 74 and 76 may be of different diameters to meet this condition. The stressable area or the strength may, of course, be equal for the two directions.

In use, the template elements 70 will be erected to define the sides of a pillar, the leaf elements 72 being raised as shown in FIG. 12. As the courses fill up, so the leaf elements 72 will be lowered onto the top of a course of back-fill material which has been laid. Thereupon, reinforcing means in the form of mesh 32, similar to the mesh shown in FIG. 13, will be secured to the member 26.1. Alternatively, the mesh 32 may merely be laid on top of the leaf element 72 and the reinforcing means 32.

Referring now to FIGS. 14, 15 and 16 of the drawings, there is shown one end of a gabion generally indicated by reference numeral 90, comprising an envelope 92 and particulate material 94 within the envelope. The permeability of the envelope 92 will be matched to the fineness of the particulate material 94 used within it.

Thus, the envelope must be able to contain the particulate material within it.

In use, gabions 90 are used and stacked on top of one another to form the lower portion of a pillar 96. Such a pillar may also be rendered to provide active support to the hanging wall 26, by making use of wedges, hydraulic fill material, or grout in the clearance space against the hanging wall.

Referring now to FIG. 16 of the drawings, there are shown gabions 98, similar to those shown in FIG. 14, but having a length corresponding to the width of a pillar 100 which is to be built. The pillar 100 may also be rendered to provide active support to the hanging wall 18, by means of the use of wedges as previously described, or of providing hydraulically placed filler material or grout in the clearance space between the top of the lower portion of the pillar and the hanging wall 18. The degree of support provided can be determined by the use of pressure-sensing devices 62, as previously described.

When making the gabions, it is important to ensure that the particulate material within the gabions is properly consolidated, such as by vibration, compaction, or compression.

It is an important feature of this invention that the particulate material in the back-fill, in the various courses, be vibrated and compacted as fully as possible, when laid. The gabions should, in turn, also be compacted as fully as possible, whether before or after laying.

Referring now to FIG. 17 of the drawings, a further variation of the pillars 24 previously described, is shown. Like reference numerals refer to like parts.

The pillar 24 is made of backfill material arranged in layers 54 and comprising vertically spaced layers of reinforcing material 32 embedded within back-fill particulate material. As the successive layers 54 are laid, so they are compacted and later consolidated by means of mobile presses, generally indicated by reference numerals 130 and 132, until the whole of the lower portion 24.2 of the pillar has been pre-loaded. If desired, each layer 54 may be consolidated by pressure after it has been laid. Alternatively, two or more layers 54 may be consolidated together. The press 132, is specially adapted to provide consolidation for the uppermost layer with minimum clearance between the upper surface of such layer, (i.e. the top of the lower portion 24.2), and the hanging wall 18. The rounded shape of the layers 54 at the opposing sides of the pillar may be obtained by formwork which is removable after consolidation of the layers. The clearance space 133 between the upper surface of the lower portion 24.2 of the pillar and the hanging wall, 18, is filled with grout 134, after consolidation by the mobile press 132 has taken place. The grout 134 is tamped in solidly under pressure to ensure that the pillar is suitably prestressed or preloaded to support the hanging wall 18.

The degree of consolidation by the presses 130 and 132, is preferably such, that the load applied to consolidate the layers, will approximate and even exceed the load which it is estimated that the pillar will ultimately have to take, in supporting the hanging wall 18. This is to ensure that the amount of deflection (if any) of the pillar under the load which it is to take ultimately will be as small as possible. It is also for this reason, that the grout layer 134, is firmly tamped in, by mechanical or hydraulic rams if necessary to ensure that the load will be taken with minimum and preferably no deflection.

The presses 130 and 132, are generally of the same construction excepting that the press 132 is made to operate within a smaller clearance space 133.

The press 130 comprises a platen 140 movable by means of forklift-type trucks or mobile cranes from one layer or zone requiring consolidation to another. On top of the platens, there are provided hydraulic jacks 148 having head members 150 adapted in operation to abut against the hanging wall 18, and to press the platen 140 firmly onto the layers 54, thereby consolidating them.

Referring to the mobile press 132, the construction is similar, excepting that the jacks 148.1, on the platen 140 are shorter than the jacks 148 because they have to operate in a smaller space, namely the clearance space 133. Thus the press 132 may be arranged to operate in a space of, say, 30 to 50 cm. More jacks 148 and 148.1 may be used than are shown in the drawings.

Each mobile press 130 and 132 is conveniently provided with its own hydraulic pump and reservoir arrangement 152 together with appropriate valve gear, to supply hydraulic fluid under pressure, to the hydraulic jacks 148 and 148.1. This will enable the hydraulic jacks to be placed under load, so as to consolidate the layers 54, as and when required.

Figure 19:
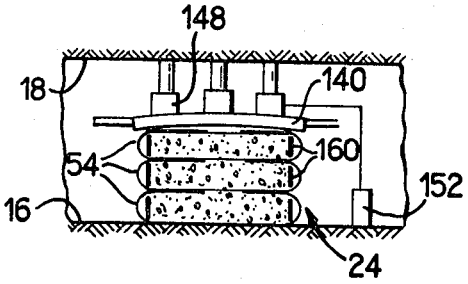
FIG. 19 shows a sectional elevation at XIX—XIX in FIG. 17.
Figure 20:
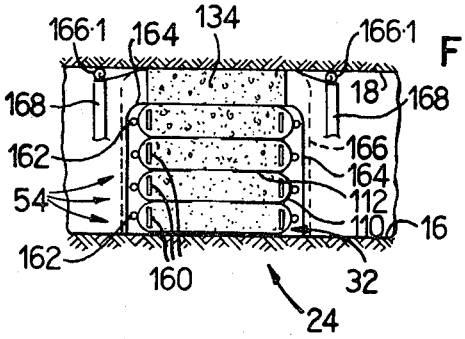
FIG. 20 shows a sectional end elevation taken at XX—XX in FIG. 17.
Figure 28:
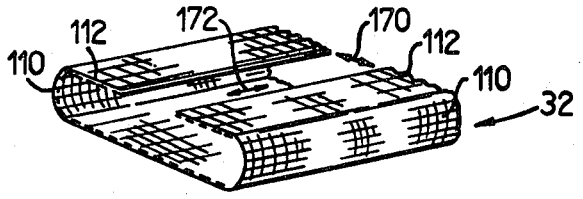
FIG. 28 shows a three-dimensional view of reinforcing material suitable for use in carrying out the invention.

Referring to FIGS. 19 and 20 of the drawings, the reinforcing material 32 is in the form of a wire mesh which has been suitably protected against corrosion and which has its side panel 110 and end panel 112 (see FIG. 28) standing upright while the particulate backfill material is being charged to form the layer 54. Once the particulate material has reached a pre-determined depth, corresponding to the height of the side panel 110, then the end panel 112 is folded over onto the backfill. If desired, prior to charging with backfill, panels 160 impervious to the particulate backfill material may be provided on the inside of the side panels 110 to ensure that the backfill particles does not pass through them. To this extent, the panels 160, also form part of the reinforcing material 32. The panels 160 may be made up of smaller mesh 160.1 (say a mesh also referred to as bird or canary mesh) and a lining 160.2 of cloth, cardboard, sheet material or plastic film (see FIGS. 29 and 30).

The length of the end panels 112 of the reinforcing material 32, will conveniently be at least half a meter but may be a meter or more if desired, so as to ensure a good purchase and frictional restraint between consecutive layers of material 32. Where desired, the end panels 112 may be bound or otherwise secured to the underside of the next succeeding layer 32 before charging of particulate material starts.

The panels 160, may be of plastic sheet material, timber panels, metal sheeting, or the like. If desired, there may be provided in addition, longitudinal beam elements in the form of rods 162 secured to the panels 110, and adapted to span the joints between adjacent reinforcing material 32. If desired, successive reinforcing layers 32 may be arranged to overlap in a longitudinal direction, along the length of the pillar 24.

In order to exclude moisture and water borne corrosive materials, which may corrode the reinforcing material 32, a plastic sheet of film 164 (see FIG. 20) may be draped over the uppermost layer before the grouting layer 134 is introduced. Instead or in addition, a plastic film or sheet 166 may be provided between the hanging wall 18 and the grout layer 134. The rolls 166.1 of plastic film will then be temporarily supported by temporary support posts 168, which can be removed and the film 166 can then be allowed to fall and drape down over the sides of the pillar 24, when grout 134 has been placed. If desired plastic sheet material or other suitable material may be used as a damp course between the lower most layer of the pillar and the foot wall 16.

Figure 29:
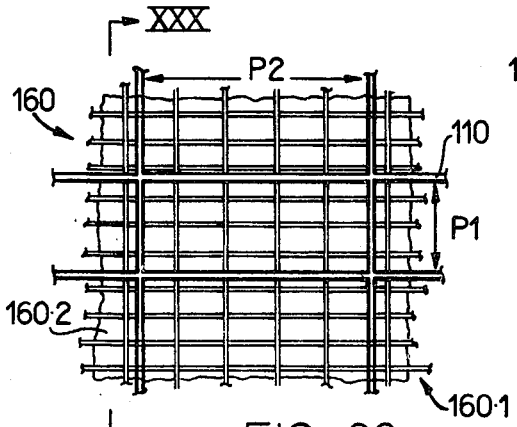
FIG. 29 shows a detail plan view of typical reinforcing material in the form of wire mesh.
Figure 30:
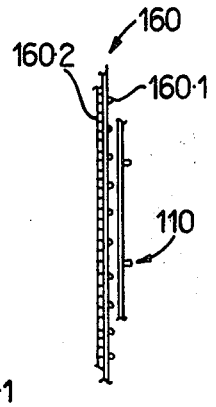
FIG. 30 shows a section at XXX—XXX in FIG. 29.

Referring to FIGS. 29 and 30 of the drawings, there is shown reinforcing material in the form of wire mesh. The wire may be of round, rectangular or elliptical cross-section. Depending upon the load which is to taken, the cross-sectional area of the wire used for the wire mesh, may be equivalent to the area of wire having a diameter of between, say, 2 mm and, say, 6 mm. The pitch $P_1$ between wires in a longitudinal direction, may be between 10 and 30 times the diameter or transverse dimension of the wire. The pitch $P_2$ may lie between once and six times the pitch $P_1$ but is preferably of the order of four times $P_1$. Reinforcing material 32 can be made of this mesh.

If desired, the reinforcing means 32 may be made up of flat metal strips, extending transversely across the width of the pillar 24, and by wires extending along the length of the wall. The cross-sectional area of metal adapted to take tensile loads in a direction transverse to the wall, that is in the direction of arrow 170, may conveniently be twice to ten times the cross-sectional area of metal, adapted to take tensile load in the direction of arrow 172. Alternatively, the wires taking load in the direction of arrow 170 may be of high tensile steel so as to be able to take a greater load.

Figure 21:
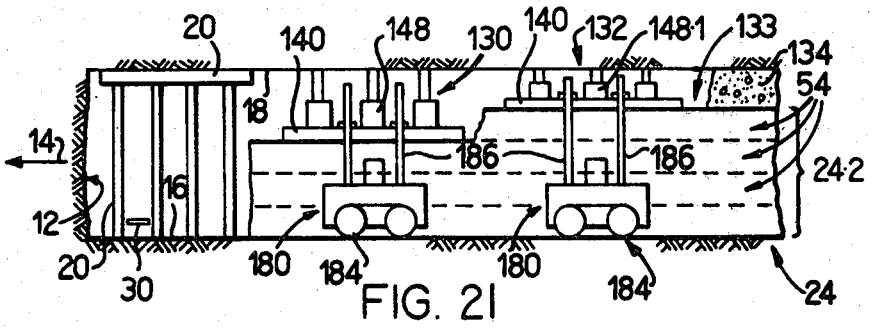
FIG. 21 shows a sectional side elevation of a pillar according to the invention, during the process of making it underground by means of a mobile press.

Referring now to FIG. 21 of the drawings, the pillar 24 built is of similar construction to that already described, and like reference numerals refer to like parts. The difference is in the type of mobile press used. The mobile press used in the building of the running pillar as shown in these drawings, is in the form of a forklift-type of vehicle generally indicated by reference numeral 180. It has wheels or tracks 184, a pair of spaced posts 186, a platen 140. The platen 140 carries a number of jacks 148 (or 148.1 where the jacks are to operate in spaces with little clearance).

The use of forklift-type of vehicles 180 makes it possible for the vehicle to move around, and for the width of the pillar, to be varied by making the platens 140 laterally movable relative to the pillar 24. For strength and lightness the platens 140, the jacks 148, and 148.1, and indeed many articles used in carrying out the method may be made of manganese aluminium alloy, for example, Duralumin.

If desired, instead of laying backfill and reinforcing material separately, prefabricated units (gabions) can be laid in courses brick-fashion to form the pillar. The courses laid correspond to the layers 54. Thereafter the courses of units may be consolidated under pressure as described with reference to FIGS. 17 to 21 of the drawings. The units (gabions) may be precompressed before laying.

Referring now to FIGS. 22 to 25, there is shown a pillar 24 for use in mining a thick seam, say, in excess of three meters. A plurality of pillars extend back from the work face 12, continuously from their front ends near the work face for a length equal to at least twice their widths W.

Where the height between the foot wall 16 and the hanging wall 18 is not excessive, say, up to a maximum of three meters, then the pillar previously described may be used, comprising a plurality of layers 54 of particulate material reinforced with reinforcing material 32. Such reinforcing material may be in the form of wire mesh, steel strips, steel plate, fibreglass mouldings, pre-stressed concrete slabs, or the like. The amount of reinforcing which is inserted will depend upon the ultimate load which the pillar is expected or designed to take. This will depend upon the depth D at which mining is taking place below the surface 235, and upon the density of the rock. As previously mentioned, at 100 meters depth the loading could be of the order of 200–300 tons per square meter. At 200 meters depth the loading could be 400–600 tons per square meter, and at 300 meters it could be, say, 700–800 tons per square meter. (1 Ton per square meter = 1O kPa).

Figures 24, 25:
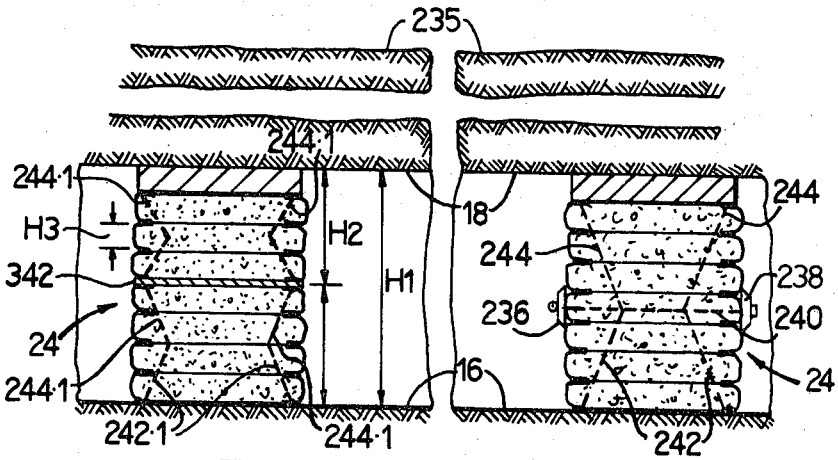
FIG. 24 shows a sectional front elevation of a pillar in accordance with the invention, taken at XXIV—XXIV in FIG. 22.
FIG. 25 shows a view similar to FIG. 24, but with a variation in construction, taken at XXV—XXV in FIG. 23.

If the load on the pillar is increased, then it will ultimately fail in diagonal tension along planes 242 and 244 (see FIGS. 24 and 25). The pillar be strengthened against such failure by means of beams 236 and 238, extending longitudinally along the sides of the pillar 24, and at about the middle, more or less in line with the intersection of the planes 242 and 244. These beams 236 are then tied across to each other by means of transverse tensile elements 240 passing through the pillar and which may be in the form of bolts or steel wire ropes. The bolts or steel wire ropes may be sheathed in a steel or plastic tube or plastic film sheath for protection against corrosion and for easy withdrawal. The beams 236 and 238 may be in the form of cold-rolled metal plate to provide a stiff section for a beam. The longitudinal spacing between the tensile elements 240 may vary from one meter to two or three meters, depending upon the strength required and upon the load which is to be taken. The spacing will also depend upon the strength of the beams 236 and 238. The spacing between elements 240 will generally not be greater than the width or thickness of the pillar.

Referring to FIG. 24 of the drawings, the arrangement there is similar to that shown for FIG. 25, except that a strong reinforcing layer 342 is provided, which is of adequate strength to turn the high pillar 24 having a height $H_1$ into two shorter and stiffer superimposed squat pillars having heights $H_2$, and have the effect that the points of intersection of the planes 242.1 and 244.1 in FIG. 24 are more widely spaced than the points of intersection of the planes 242 and 244 in FIG. 25.

In practice, the height $H_1$ will depend upon the thickness of the seam of coal which is being mined. This may vary from 2–3 meters to 5–10 meters. However, when the height $H_1$ is very large then, depending upon the loads which are to be taken, the heights $H_2$ of the squat pillars will be reduced to a value preferably not exceeding the minimum cross-sectional dimension of the pillar, i.e. the width or thickness of the pillar.

When the seam of coal which is being mined is shallow, there may be some relaxation with regard to the height of the pillar relative to its width. However, when seams deep down are being mined, and where loads of the order of 1000 tons per square meter are contemplated, then the overall height $H_2$ of a squat pillar, as shown in the lower half of the pillar shown in FIG. 24, will be much less than the tall pillar of FIG. 25, shown for an application where the contemplated loading is much less.

Figure 22:
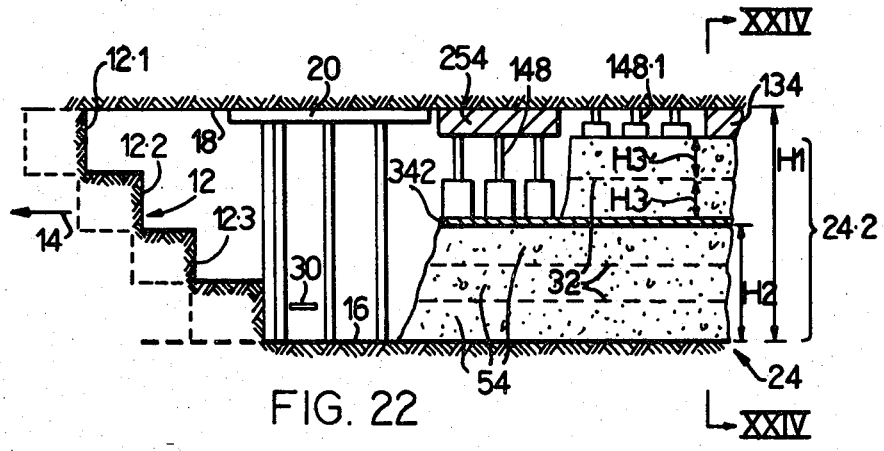
FIG. 22 shows a sectional side elevation at XXII—XXII in FIG. 23.
Figure 23:
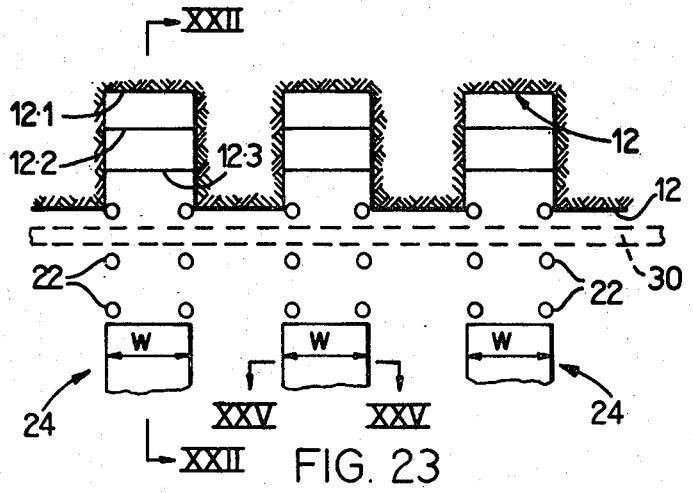

The various layers of particulate material 54, together with their reinforcing mesh layers 32, and the reinforced cap or foot plate 342, are consolidated by vibration, compaction, or the like, and ultimately by being compressed by means of jacks 148 and 148.1, pressing directly against the hanging wall 18, as shown by jacks 148.1, or indirectly via a spacer 254, as shown by jacks 148 (see FIG. 22).

When the seam being mined is very thick, then the working face 12 may be worked in steps 12.1, 12.2, and 12.3.

The spacing between layers of reinforcing mesh 32 is given by $H_3$. Here again, the strength of the mesh will be determined by the horizontal component of the vertical loading which the mesh is expected to take when the pillar is subjected to its vertical load. The strength of the mesh will be chosen with a suitable factor of safety being taken into account, say, 1,6.

Figure 26:
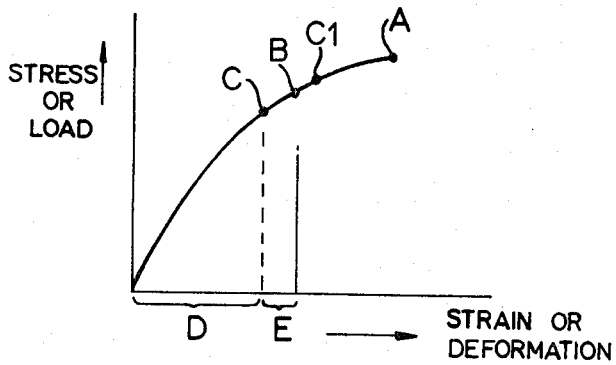
FIG. 26 shows a stress strain (load-deformation) diagram of a pillar according to the invention.

Referring now to FIG. 26 of the drawings, reference numeral 260 indicates a Stress-Strain or Load-Deformation curve which the layers of particulate material 54, with reinforcing material 32, are expected to take as they are loaded. The pillar is designed to take an ultimate stress indicated by point A which is appreciably higher than the stress indicated by point B and which represents the stress or load which it is expected (from the depth of working below surface) that the pillar will ultimately have to take. In practice, the various layers 54 and reinforcing material 32 will be stressed by preloading by abutment against the hanging wall 18, to an extent indicated by point C. Thereafter the upper layer 134 in the form of grout is tamped or rammed in under pressure in an endeavour to take the stress of the grout also, up to a value indicated by point C. All the layers will then have been pre-compressed, and upon the load being taken subsequently, the initial strain D will already have been taken up and the minor amount of strain E is all that will take place in the pillar. The spacing between points C and B has been exaggerated in the diagram, for clarity.

It is, of course, possible for the pre-loading, to take place to the same value as the stress B, or even slightly beyond it, say, to a point C1. This will then ensure that the particulate material in the pillar has been fully consolidated by being pre-loaded so as to ensure that the load from the hanging wall will be taken with minimum or no deflection or deformation of the pillar. The degree of deflection or deformation of the pillar under pre-loading or precompression is expected to be about $\frac{1}{8}$ or 1/16 of the original height of the pillar.

Figure 27:
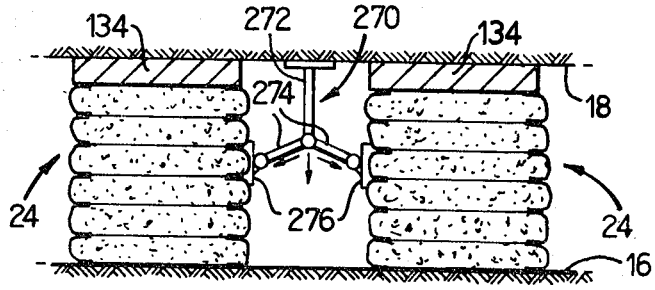
FIG. 27 shows a sectional front elevation of a further development of the invention.

Referring to FIG. 27 of the drawings, a further possibility suggests itself of preventing bursting of adjacent pillars. The arrangement shown in FIG. 27 is believed to be particularly useful in very thick seams which are being mined, say, from about 6 meters upwards. If the descent of the hanging wall 18 is accurately predeterminable, i.e. it is known almost exactly how far it will descend to the final settled position, then, by making use of the toggle mechanism 270, the descent of the roof 18 can be transmitted to the post 272 which will then urge the laterally extending posts 274 to abut against beams 276 to prevent outward bulging of the pillars 24.

Figure 31:
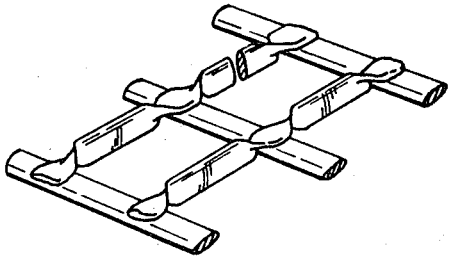
FIG. 31 shows a wire mesh arrangement having wires of elliptical section secured in criss-cross fashion, and suitable for use as reinforcing in the pillars according to the invention.

Referring to FIG. 31 of the drawings, there is shown a wire mesh material of elliptical section, but which, between adjacent wires, are twisted to present the maximum width as a greater depth. It is believed that such wires of elliptical section, when twisted in this fashion, will provide increased grip and greater frictional resistance to movement within the particulate backfill material.

The invention accordingly extends also to a method of mining coal in coal mines, which includes the step of having the work face more advanced in some places than in others, there being provided pillars extending backwardly from a work space immediately behind the work face, the leading ends of the pillars being aligned with those parts of the work face which are more advanced than the other parts of the work face.

It will be realised that the length of various pillars may vary depending upon working conditions, access to workings for men, and movement of materials. The length of a pillar in a particular location may accordingly be as small as twice its width. In another, more remote, location it may extend continuously. Where possible, continuous pillars will be preferred because of cost savings in not having to make off ends in a manner similar to the sides.

The step of consolidation of a layer of particulate backfill, may include the use of cementing materials or synthetic chemical materials to promote cohesion in the backfill.

When formwork or temporary structures are used while backfilling and consolidation of the particulate backfill material is in progress, then such formwork and structures will be capable, where necessary, of resisting all the pressures resulting from the construction of the pillar.

The slight camber which the platen 140 may have (see FIG. 19), will assist in providing good access for effective grouting. The grout layer 134 is intended to have the same width as the pillar and may be constrained between removable forms, while setting. Such removable forms will exert pressure on the grout and will prevent grout breaking out.

The width of the pillar, while depending upon the thickness of the coal seam, the depth below the surface, and the condition of the hanging wall, will also depend upon the availability, quality, and nature of the backfill. The use of burnt ash and dolomite and limestone, besides providing a cementitious binding material in the backfill, will also mitigate against corrosive attack of reinforcing material in the pillar structure. It will also provide savings in the cost of the backfill.

The vertical spacing between successive reinforcing layers 32, will be the subject of design by considering the load which the pillar is expected to take, the nature of the backfill, the cost of the reinforcing layers 32, and the economic gain which is to be achieved by making use of the pillar in winning material otherwise lost economically when left in situ for support. The vertical spacing between successive layers of lateral constraint means will vary depending upon its position in the pillar.

The pillars will be designed to take loads which will be less than those which will cause them to collapse or fail due to diagonal stress. In other words, the maximum resistance of the pillar to diagonal tensile stress will be above that imposed by the load which the pillar carries.

The use of the mobile press reduces the degree of deflection of the pillar under load to a minimum when the pillar receives its full loading of the roof. Such minimum deflection also reduces to a minimum the subsidence of strata and other movement.

It is believed that even if the loading on the pillar increases so that it fails under diagonal tension along the planes 242 and 244, then the pillar will yield gradually and will not fail by shattering as when brittle material shatters under excessive compressive loads.

This method of supporting a hanging wall according to the invention, may be used advantageously by building pillars or running pillars according to the invention between in situ pillars left for support in mined-out areas. This makes possible the recovery of coal from such in situ pillars without increasing the danger of the hanging wall coming down. The value of the coal to be extracted will, of course, have to be balanced against the cost of making such pillars, to ensure that it will be economically possible to extract such coal.

The particulate material used as a backfill in carrying out this invention should preferably be strong and have high inter-particulate friction.

I claim:

1. In mining, a method of supporting the hanging wall which includes providing support pillars between the hanging wall and the foot wall, by building lower portions of the pillar to include particulate backfill material; and using jacking means in clearance spaces above the backfill and below the hanging wall to bear against the hanging wall to exert a downward pressure on the particulate backfill material, thereby obtaining consolidation of the backfill material in the lower portions of the pillars.

2. A method as claimed in claim 1, in which the backfill material is fine such that about half by mass would pass a sieve of 0.85 mm, and such that only 1% by mass would be retained on a sieve size of 6.76 mm.

3. A method as claimed in claim 1 in which, after consolidation of the backfill in the lower portion of a pillar the clearance space is filled under pressure with load-taking fill which thereby exerts a downward pressure on this lower portion by bearing against the hanging wall.

4. A method as claimed in claim 1, in which the downward pressure exerted on a lower portion before filling of the clearance space, is at least 9/10 of the load which the pillar is expected to take.

5. A method as claimed in claim 4, in which the downward pressure exerted on a lower portion before filling of the clearance space takes place, is in excess of the load which the pillar is expected to take.

6. A method as claimed in claim 1, in which the lower portion of a pillar is built up in layers of backfill with layers of reinforcing material at different elevations between layers of backfill in the lower portion.

7. A method as claimed in claim 6, in which the vertical spacing between layers of reinforcing material is at the most equal to one-third the minimum cross-sectional dimension of the pillar.

8. A method as claimed in claim 6, which includes providing retaining walls on opposite sides of a pillar, and in which the reinforcing material engages with the retaining walls to constrain them against outward bulging.

9. A method as claimed in claim 7, in which consolidation of backfill material in a lower portion takes place on one or more layers of backfill at a time.

10. A method as claimed in claim 7, in which the particulate backfill material is made up into the form of gabions which comprise the backfill material contained in envelopes of reinforcing material, and in which the lower portion of a pillar is built by laying the gabions in layers.

11. A method as claimed in claim 10, in which at least some of the gabions are precompressed before being laid.

12. A method as claimed in claim 1, in which reinforcing material is provided in the backfill material in the form of a slab, metal plate, fibreglass or geotextile cap, or the like, at a height which is at the most equal to the minimum cross-sectional dimension of the pillar.

13. A method as claimed in claim 1, in which a pillar is reinforced against outward bulging under load, by having beams on opposite sides extending generally parallel to one another, and by having tie members passing transversely through the pillar and through the beams, and placing the tie members under stress, thereby tying the beams on opposite sides of the pillar together.

14. A method as claimed in claim 13, in which the tie members are in the form of bolts or steel wire ropes which have been sheathed in outer protective sheaths.

15. A method as claimed in claim 13, in which the tie members are spaced along the length of the pillar at intervals at the most equal to the minimum cross-sectional dimension of the pillar.

* * * * *